US006936117B1

(12) United States Patent
Ishikawa et al.

(10) Patent No.: US 6,936,117 B1
(45) Date of Patent: Aug. 30, 2005

(54) SILVER ALLOY WITH COLOR FASTNESS

(76) Inventors: Seiichiro Ishikawa, 2-24-8 Higashi-nippori, Arakawa-ku, Tokyo (JP); Keiichi Suzuki, 1-50-15 Arakawa, Arakawa-ku, Tokyo (JP)

( * ) Notice: Subject to any disclaimer, the term of this patent is extended or adjusted under 35 U.S.C. 154(b) by 0 days.

(21) Appl. No.: 10/902,369

(22) Filed: Jul. 29, 2004

(51) Int. Cl.[7] ..... C22C 5/00
(52) U.S. Cl. ..... 148/430; 148/431; 420/502; 420/503
(58) Field of Search ..... 420/502, 503; 148/430, 431

(56) References Cited

U.S. PATENT DOCUMENTS 5,972,131 A * 10/1999 Asada et al. ..... 148/430
6,245,166 B1 * 6/2001 Shibuya et al. ..... 148/431

* cited by examiner

*Primary Examiner*—Sikyin Ip
(74) *Attorney, Agent, or Firm*—Jordan and Hamburg LLP

(57) ABSTRACT

A silver alloy with color fastness includes silver as major component; and a small quantity of copper, zinc and nickel so that it can be prevented to oxidize, and it can use metal with easy procurement without special metal and manufacture a alloy with color fastness.

2 Claims, 2 Drawing Sheets

SILVER ALLOY WITH COLOR FASTNESS

FIELD OF THE INVENTION

This invention relates to a silver alloy with color fastness which can be used for silverware such as ornament, accessories and tableware.

BACKGROUND OF THE INVENTION

The conventional silver alloy with color fastness is composed of 3.0 to 9.0% by weight of indium, 0.02 to 0.09% by weight of aluminum and silver.

However, since such the silver alloy with color fastness contains aluminum, it is easy to oxidize.

SUMMARY OF THE INVENTION

Accordingly, it is an object of the present invention to provide a silver alloy with color fastness which can be prevented to oxidize.

It is another object of the present invention to provide a silver alloy with color fastness which can use metal with easy procurement without using a special metal.

The present invention is understood to encompass embodiments which include all or only a portion of the above objects, features and advantages which, unless recited in claims defining the invention, are understood not to limit interpretation of such claims. The above, and other objects, features and advantages of the present invention will become apparent from the following description read in conjunction with the accompanying drawings, in which like reference numerals designate the same elements.

It is to be expressly understood, however, that the drawings are for the purpose of illustration and description only, and are not intended as a definition of the limits of the invention.

DETAILED DESCRIPTION OF THE PREFERRED EMBODIMENTS

Figure 1:
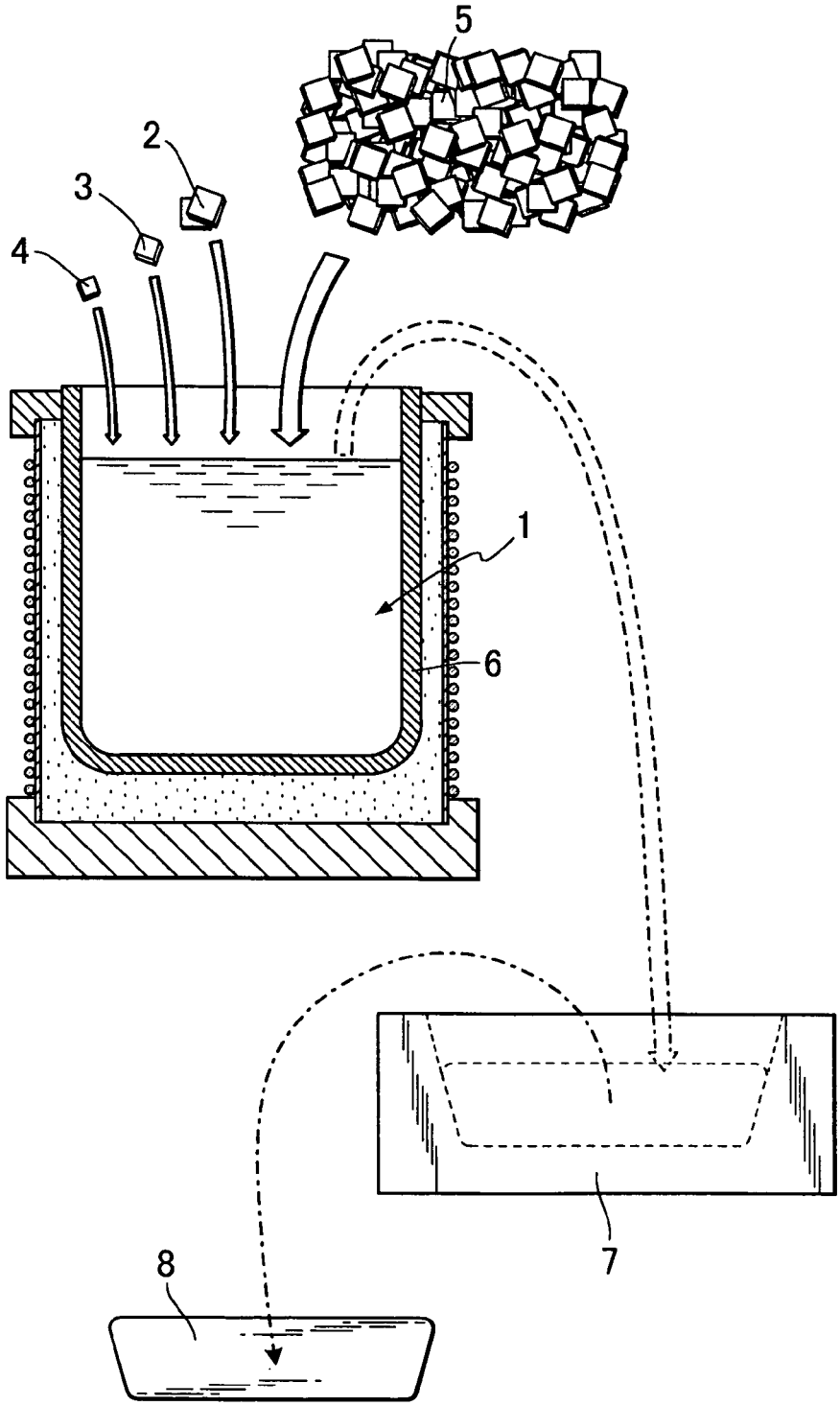
FIG. 1 is an explanation view showing a first embodiment of the present invention.

Preferred embodiments of the present invention are described in more detail below referring to the accompanying drawings. An understanding of the present invention may be best gained by reference FIG. 1.

Reference numeral 1 designates a silver alloy with color fastness which can be prevented to oxidize and is comprised of a 1.25 to 1.35% by weight, 1.25% of a copper 2 in this embodiment; 0.35 to 0.45% by weight, 0.35% by weight, 0.35% of a zinc 3 in this embodiment; 0.24 to 0.37% by weight, 0.24% by weight of a nickel 4 in this embodiment; and a silver 5 as a remained part thereof.

For the silver alloy 1 with color fastness with such ingredient amount, it is melted by use of a graphite furnace 6 in the atmosphere like the manufacture method of the usual commercial metal material, and it is cast to a metal mold 7 and obtained an ingot 8 of a predetermined shape. After that, the ingot 8 is burned with annealing behavior about 55 degrees under reduced pressure for 30 minutes, and then the silver alloy 1 with color fastness is manufactured.

The silver alloy 1 with color fastness with the ingredient amount can be prevented to oxidize and is excellent in color fastness. Also it has the same color tone as the white precious metals which performed rhodium plating processing.

Other embodiments of the present invention will now be described referring to FIG. 2. Through the drawings of the embodiments, like components are denoted by like numerals as of the first embodiment and will not be further explained in great detail.

Figure 2:
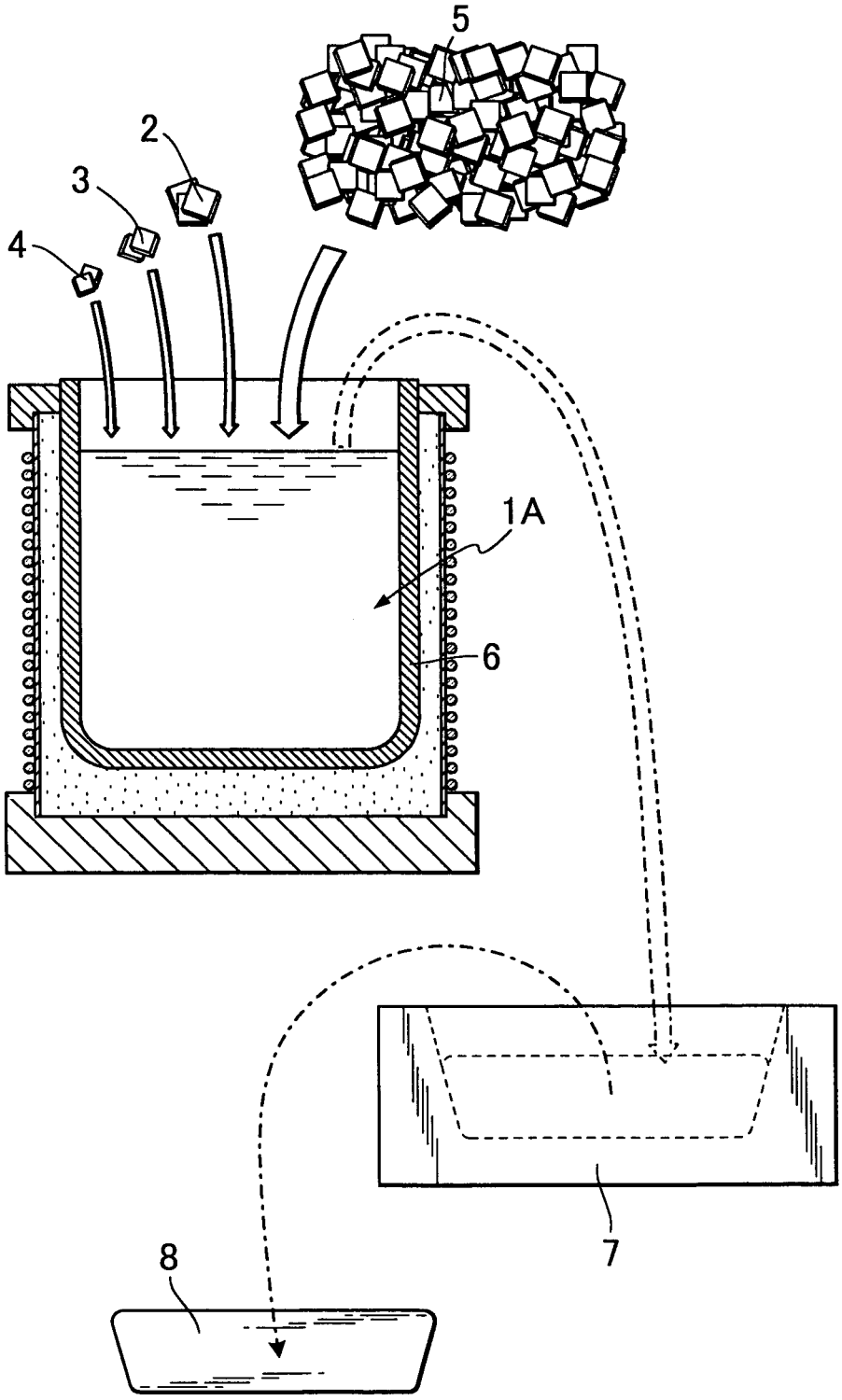
FIG. 2 is an explanation view showing a second embodiment of the present invention.

A second embodiment of the present invention is shown in FIG. 2 and provides a silver alloy with color fastness 1A distinguished from the first embodiment in that the silver alloy is comprised of 1.35% by weight of a copper 2; 0.45% by weight of a zinc; 0.37% by weight of a nickel 4; and a silver 5 as a remained part thereof. The silver alloy 1A with color fastness according to the second embodiment has similar advantages to that according to the first embodiment.

As set forth above, the advantages of the invention are as follows:

(1) A silver alloy with color fastness includes silver as major component; and a small quantity of copper, zinc and nickel so that it excels in color fastness and prevents to oxidize.

(2) As discussed above, since silver and small quantity of copper, zinc and nickel are used, it can use metal with easy procurement without special metal. In addition, it can be enlarged indurative behavior by mixture of copper, it can be enlarged degree of brilliancy by mixture of zinc; and it can easily put together by mixture of nickel.

For this reason, there is no necessity for plating; indurative behavior and degree of brilliancy increase; and it is easy and cheaply to manufacture.

(3) As discussed above, claim 2 has the same effect as the above (1) and (2), and it is manufactured the high purity silver alloy of 98% by weight.

What is claimed is:

1. Silverware comprised of an oxidation-resistant colorfast alloy consisting of, by weight, 1.25 to 1.35% copper, 0.35 to 0.45% zinc, 0.24 to 0.27% nickel, and the balance, silver.

2. Tableware comprised of an oxidation-resistant colorfast alloy consisting of, by weight, 1.25 to 1.35% copper, 0.35 to 0.45% zinc, 0.24 to 0.27% nickel, and the balance, silver.

* * * * *